US007646348B2

(12) United States Patent
Huang et al.

(10) Patent No.: US 7,646,348 B2
(45) Date of Patent: Jan. 12, 2010

(54) GROUNDED SELF-COMPLEMENTARY ANTENNA FOR ELECTRONIC DEVICE

(75) Inventors: Jiunn-Ming Huang, Taipei Hsien (TW); Chia-Tien Li, Taipei Hsien (TW); Shen-Pin Wei, Taipei Hsien (TW); Kuan-Hsueh Tseng, Taipei Hsien (TW)

(73) Assignee: Winstron Neweb Corporation, Taipei Hsien (TW)

( * ) Notice: Subject to any disclaimer, the term of this patent is extended or adjusted under 35 U.S.C. 154(b) by 341 days.

(21) Appl. No.: 11/802,096

(22) Filed: May 18, 2007

(65) Prior Publication Data

US 2008/0088522 A1 Apr. 17, 2008

(30) Foreign Application Priority Data

Jun. 5, 2006 (TW) ..... 95119922 A

(51) Int. Cl.
*H01Q 1/24* (2006.01)
*H01Q 1/48* (2006.01)

(52) U.S. Cl. ..... 343/702; 343/846

(58) Field of Classification Search ..... 343/702, 343/830, 846, 829

See application file for complete search history.

(56) References Cited

FOREIGN PATENT DOCUMENTS

TW 595041 6/2004

OTHER PUBLICATIONS

"L-Shaped Self-complementary Antenna", Pu Xu, Kyohei Fujimoto, Jun. 3, 2003, IEEE, pp. 95-98.

"L-Shaped Self-complementary Antenna Analyses Based on the Experiment and Simulation", Pu Xu, Kyohei Fujimoto, Masao Sakuma, Sep. 4, 2005, IEEE, pp. 670-672.

"Self-complementary Antennas", Yasuto Mushiake, IEEE Antennas and Propagation Magazine, vol, 34, No. 6, Dec. 1992, pp. 23-29.

Yasuto Mushiake, "Self-Complementary Antennas", IEEE Antennas and Propagation Magazine, vol. 34, No. 6, pp. 23-29, Dec. 1992.

*Primary Examiner*—Michael C Wimer

(57) ABSTRACT

A metal complementary element of a grounded self-complementary antenna for an electronic device and a metal grounding element of the electronic device contact with each other, are electrically connected to each other or are a same article so as to substantially enlarge an area of a grounding end of the self-complementary antenna to enable the self-complementary antenna to have the good radiation efficiency and the broader bandwidth such that the radio signal transmission effect of the electronic device can be elevated.

6 Claims, 5 Drawing Sheets

GROUNDED SELF-COMPLEMENTARY ANTENNA FOR ELECTRONIC DEVICE

BACKGROUND OF THE INVENTION

1. Field of the Invention

The present invention relates to an electronic device with a built-in antenna, and more particularly to an electronic device built in with a self-complementary antenna (SCA).

2. Description of Related Art

An antenna is built in some notebook computers to allow the notebook computers to have the radio electromagnetic signal receiving function. There are many built-in notebook computer antennas, such as the ones disclosed in U.S. Pat. No. 6,995,718, U.S. Pat. No. 6,853,336, U.S. Pat. No. 6,833,818, U.S. Pat. No. 6,809,690, U.S. Pat. No. 6,724,348, U.S. Pat. No. 6,628,236, U.S. Pat. No. 5,828,341 and Taiwan Utility Model Patent No. M279,992 and M281,308. The antennas disclosed in the patents mentioned above almost are single-element-typed antennas, the electromagnetic signal transmission efficiency is rather low and the electromagnetic signal transmission bandwidth is rather narrow.

Taiwan Patent No. 595,041 discloses a similar self-complementary antenna. The antenna comprises a coaxial transmission line with a central wire and an outer layer grounding conductor, a first metal radiating sheet and a second metal radiating sheet, in which the shapes of the first and the second metal radiating sheets generally are complementary to each other. The both radiating sheets are formed on a medium base plate by means of printing or etching and disposed symmetrically on two sides of the medium base plate relative to a central line of the medium base plate to form two arms of the antenna. Besides, each of the both metal radiating sheet comprises a feeding point connected to a center wire or an outer layer grounding conductor of the coaxial transmission line. The antenna mentioned above has a rather wide bandwidth.

SUMMARY OF THE INVENTION

For further allowing an electronic device with radio transmission function to elevate the signal transmission efficiency, the present invention is proposed.

The main object of the present invention is to provide a grounded self-complementary antenna for an electronic device, capable of elevating the electromagnetic signal transmission efficiency of the electronic device.

Another object of the present invention is to provide a grounded self-complementary antenna for an electronic device, capable of broadening the electromagnetic signal bandwidth for an electronic device.

For attaining to the objects mentioned above, a grounded self-complementary antenna for an electronic device according to the present invention comprises a metal radiator used for responding to electromagnetic waves in a certain wavelength range and a metal complementary element adjacent to the metal radiator, an open zone is disposed at an inner portion thereof wherein shapes of the open zone and the metal radiator are symmetry to allow the metal radiator and the metal complementary element to form a self-complementary antenna. One end of the metal radiator adjacent to the metal complementary element has a feeding point for transmitting electromagnetic signals. The metal complementary element and the a metal grounding element of the electronic device are electrically connected to each other so as to substantially enlarge an area of a ground end of the self-complementary antenna to enable the self-complementary antenna to obtain the good radiation efficiency and broaden the bandwidth so as to elevate the radio signal transmission effect of the electronic device.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
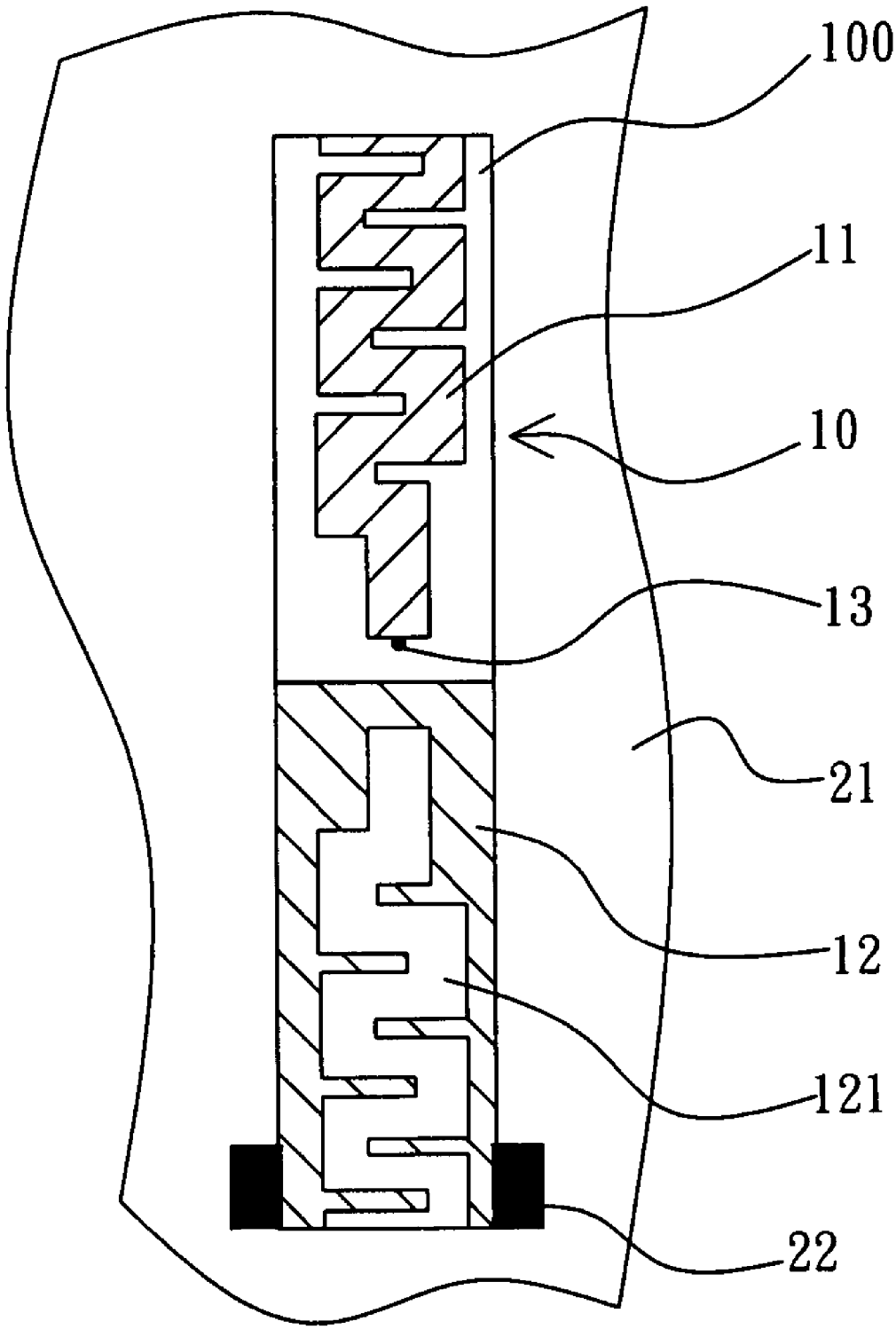
FIG. 1 is schematic view, showing a grounded self-complementary antenna for an electronic device of a first embodiment of the present invention.

Please refer to FIG. 1. A grounded self-complementary antenna for an electronic device according to the present invention is used for elevating the radio signal transmission effect of the electronic device. A self-complementary antenna 10 of a first embodiment according to the present invention comprises a metal radiator 11 and a metal complementary element 12 adjacent thereto. The metal radiator 11 and the metal complementary element 12 can be formed on one face of an insulation plate 100 by means of circuit printing. The metal radiator 11 has a specific shape to respond to electromagnetic waves in a certain wavelength range. An open zone 121 is disposed inside the metal complementary element 12. The shapes of the open zone 121 and the metal radiator 11 are symmetrical to each other to allow the metal radiator 11 and the metal complementary element 12 to form the self-complementary antenna 10. One end of metal radiator 11 adjacent to the complementary element 12 has a feeding point 13 for outputting/inputting electromagnetic signals.

The present invention is characterized in that the metal complementary element 12 of the self-complementary antenna 10 is caused to get in touched with or electrically connect with a metal grounding element 21 of the electronic device so as to substantially enlarge the area of a grounding end of the self-complementary antenna 10 to enable the self-complementary antenna 10 to obtain the good radiation efficiency and elevate the bandwidth. The metal grounding element 21 of the electronic device can be a metal housing, metal frame or electromagnetic wave prevention metal sheet of the electronic device. The metal complementary element 12 and the metal grounding element 21 of the electronic device can contact with each other directly or be electrically connected to each other through a conduction sheet 22. The electronic device can be cellular phone, a personal digital assistant with radio communication function, palm computer, notebook computer or desktop computer.

Figure 2A:
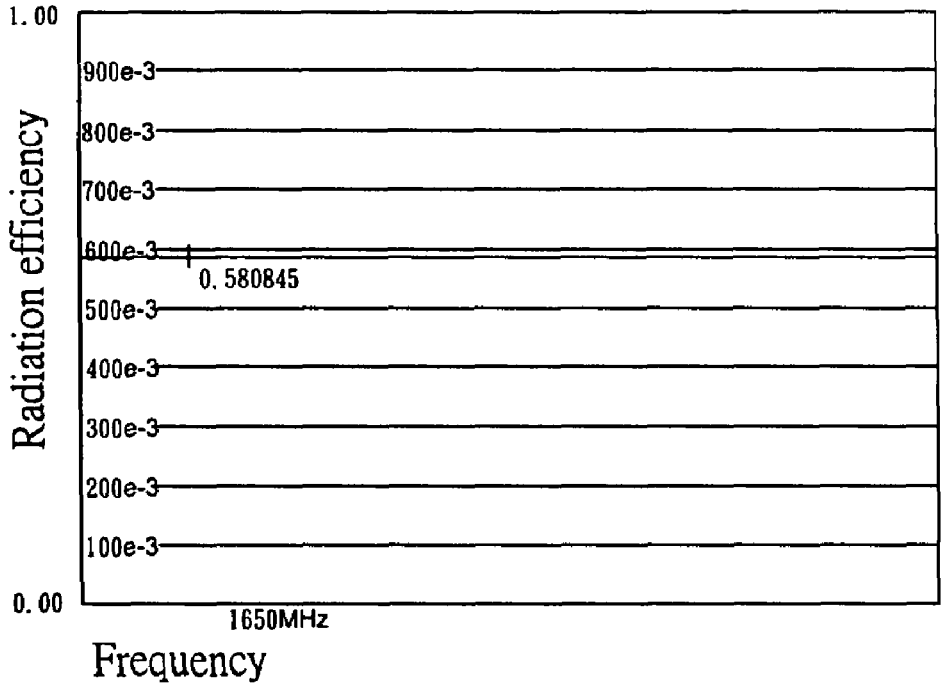
FIG. 2A is a radiation efficiency test graph when a metal complementary element of a first embodiment of the present invention is not electrically connected to an electronic device.
Figure 2B:
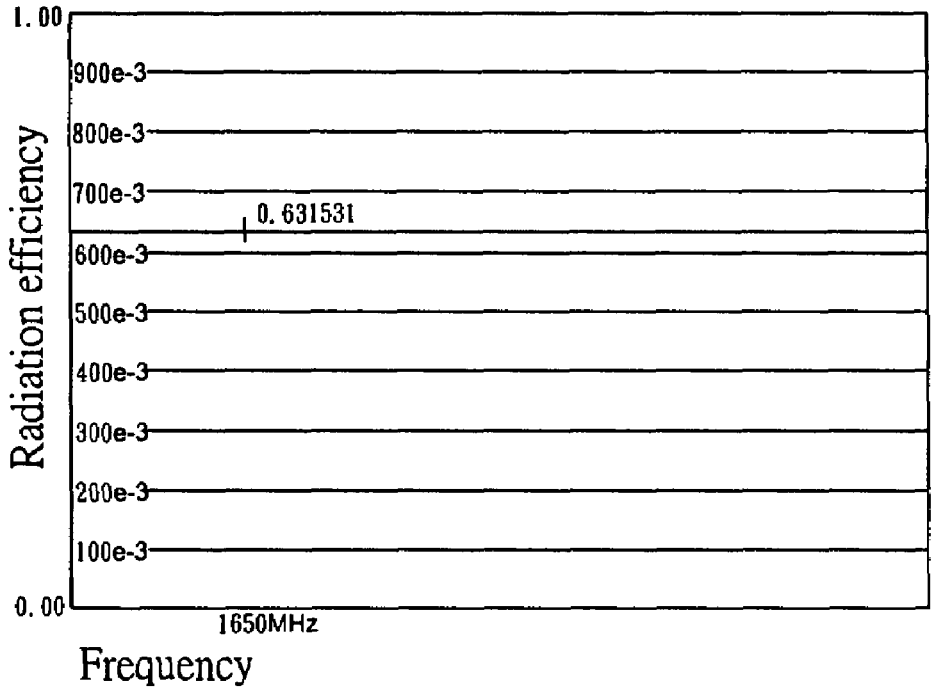
FIG. 2B is a radiation efficiency test graph when a metal complementary element of a first embodiment of the present invention is electrically connected to an electronic device.
Figure 3A:
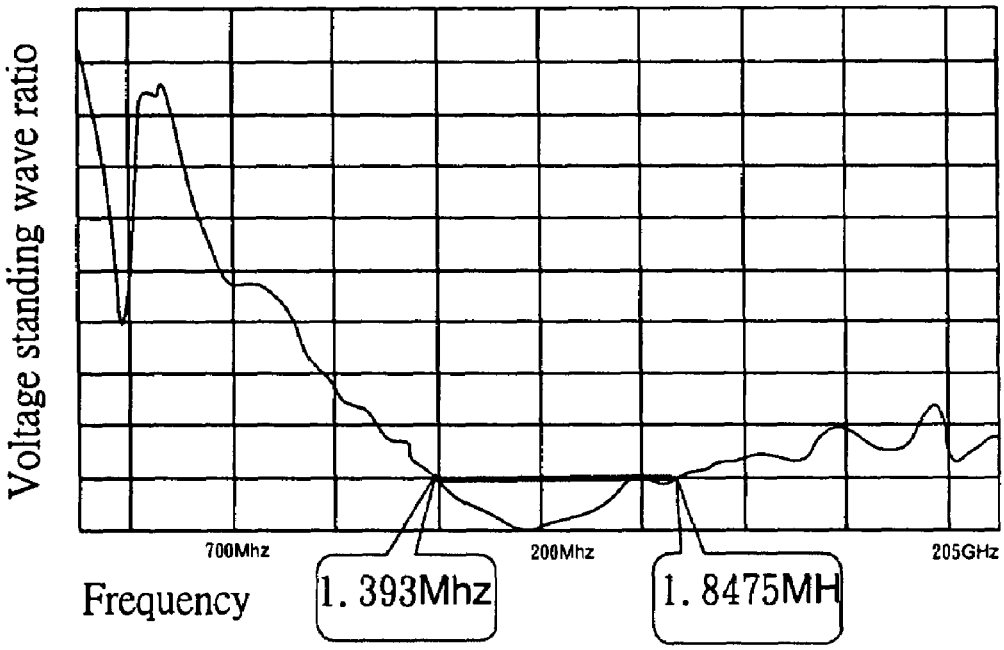
FIG. 3A is a voltage standing wave ratio test graph when a metal complementary element of a first embodiment of the present invention is not electrically connected to an electronic device.
Figure 3B:
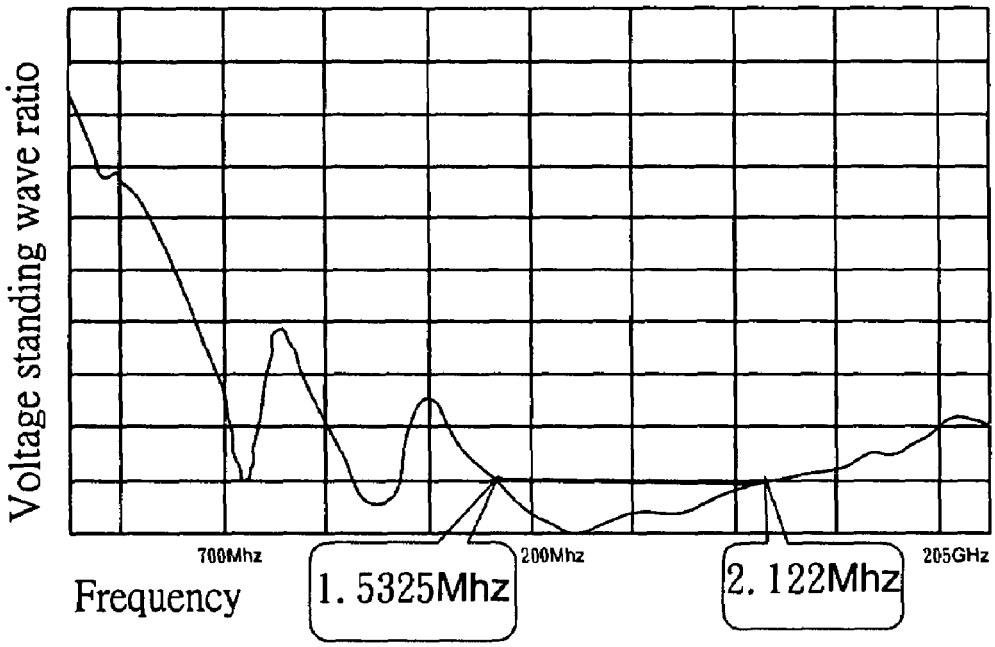
FIG. 3B is a voltage standing wave ratio test graph when a metal complementary element of a first embodiment of the present invention is electrically connected to an electronic device.

Please refer to FIGS. 1, 2A, 2B, 3A and 3B. When the metal complementary element 12 of the self-complementary antenna 10 does not contact with or is not electrically connected to the metal grounding element 21 of the electronic device, the radiation efficiency of the self-complementary antenna 10 is 0.58 as FIG. 2A shows and when a voltage standing wave ratio is 2. A response frequency is between 1.393 MHz ($10^6$ Hz) and 1.8475 MHz, the bandwidth thereof is 0.45 MHz as FIG. 3A shows. When the metal complementary element 12 of the self-complementary antenna 10 directly contacts with or is electrically connected to the metal grounding element 21 of the electronic device, the radiation efficiency of the self-complementary antenna 10 is 0.63 as FIG. 2B shows and when a voltage standing wave ratio is 2. A response frequency is between 1.5325 MHz and 2.212 MHz, the bandwidth thereof is 0.68 MHz as FIG. 3B shows. From the test results mentioned above we can know that the signal transmission efficiency of the self-complementary antenna 10 can be elevated and the signal transmission bandwidth can be broadened when the metal complementary element 21 of the self-complementary antenna 10 and the metal grounding element 21 of the electronic device contact with each other or are electrically connected to each other.

Figure 4:
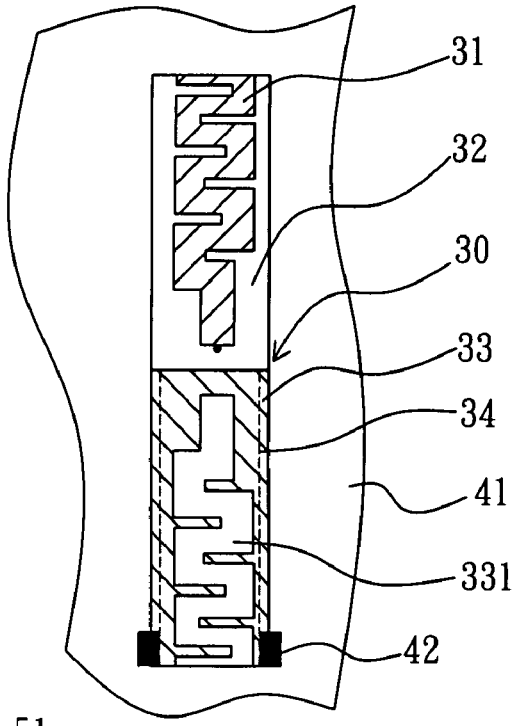
FIG. 4 is schematic view, showing a grounded self-complementary antenna for an electronic device of a second embodiment of the present invention.

Please refer to FIG. 4. FIG. 4 shows a grounded self-complementary antenna for an electronic device of a second embodiment according to the present invention. A metal radiator 31 of a self-complementary antenna 30 does not contact with a metal grounding element 41 through a first insulation material layer 32 and a metal complementary element 33 of the self-complementary antenna 30 contacts with the metal grounding element 41, but the edges of a open zone 331 of the metal complementary element 33 does not contact with the metal grounding element 41 through a second insulation material layer 34. The first and the second insulation material layers 32 and 34 can also be integrated together and are a twin adhesive; two faces of the twin adhesive can respectively be stuck onto the self-complementary antenna 30 and the metal grounding element 41. The metal complementary element 33 and the metal grounding element 41 can further be electrically connected with each other through a conducting pad 42. The self-complementary antenna 30 of the present embodiment is convenient to be combined with the metal grounding element 41 of the electronic device to allow the electronic device to be combined with the different shaped self-complementary antenna 30 depending on the need.

Figure 5:
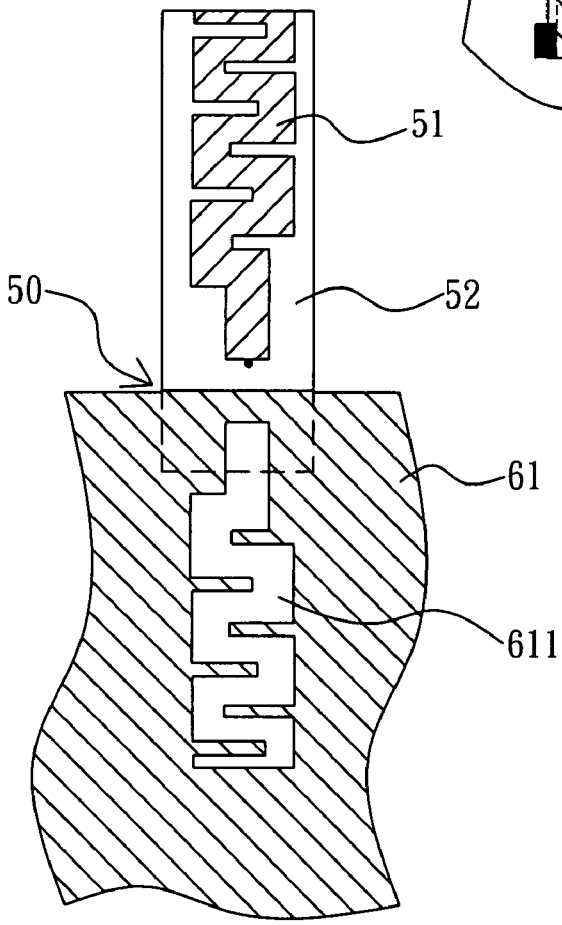
FIG. 5 is schematic view, showing a grounded self-complementary antenna for an electronic device of a third embodiment of the present invention.

Please refer to FIG. 5. FIG. 5 shows a grounded self-complementary antenna for an electronic device of a third embodiment according to the present invention. A metal radiator 51 of a self-complementary antenna 50 is formed on one face of an insulation plate 52 that is combined with a metal grounding element 61 of an electronic device at one side thereof. The metal grounding element 61 has an open zone 611 symmetrical to the metal radiator 51. The metal radiator 51 and the open zone 611 of the metal grounding element 61 are utilized to form the self-complementary antenna 50. A metal complementary element of the self-complementary antenna 50 of the present embodiment is the metal grounding element 61 of the electronic device.

Figure 6:
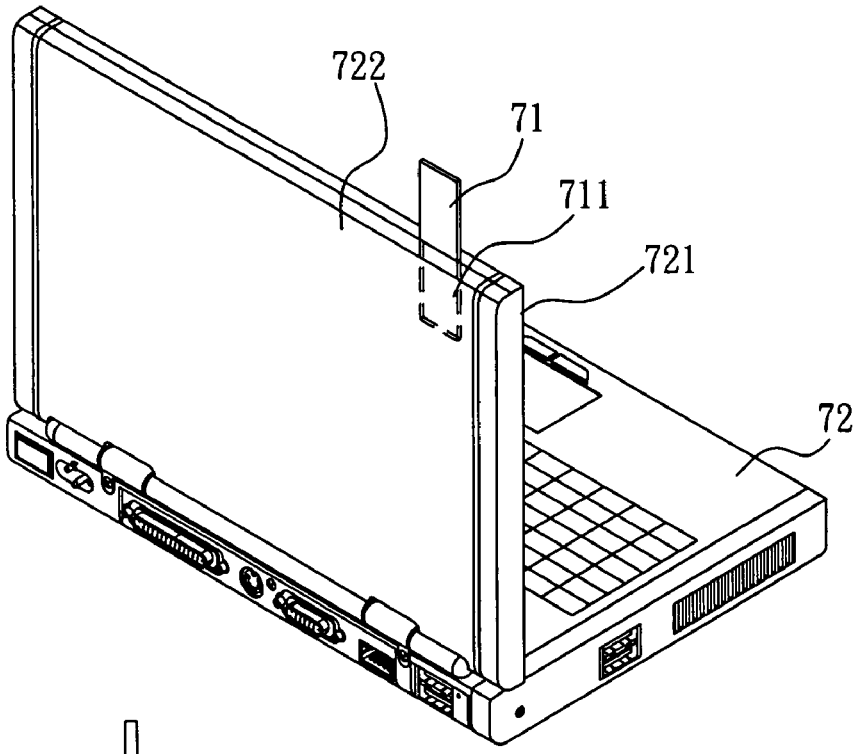
FIG. 6 is schematic view, showing a grounded self-complementary antenna for an electronic device of a fourth embodiment of the present invention.

Please refer to FIG. 6. FIG. 6 shows a grounded self-complementary antenna for an electronic device of a fourth embodiment according to the present invention. A metal complementary element 711 of a self-complementary antenna 71 and a metal grounding housing 722 of a liquid crystal display 721 of a notebook computer 72 are combined with and electrically connected to each other.

Figure 7:
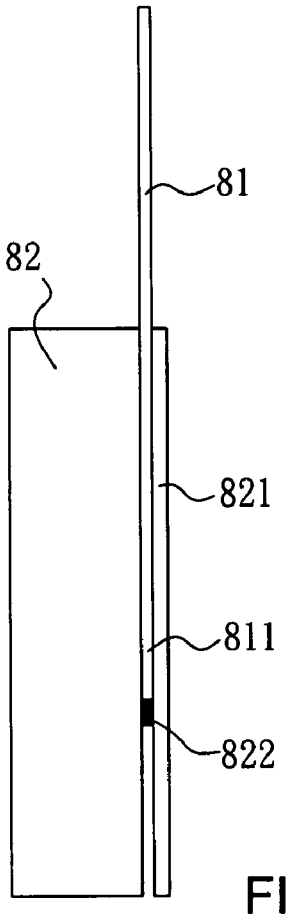
FIG. 7 is schematic view, showing a grounded self-complementary antenna for an electronic device of a fifth embodiment of the present invention.

Please refer to FIG. 7. FIG. 7 shows a grounded self-complementary antenna for an electronic device of a fifth embodiment according to the present invention. A bottom of a metal grounding element 811 of a self-complementary antenna 81 is combined with and is electrically connected to a metal grounding housing 821 of an electronic device 82 such as a cellular phone, a personal digital assistant with radio communication function or a palm computer.

A metal complementary element of a self-complementary antenna and a metal grounding element of an electronic device are caused to contact with or be electrically connected to each other or are a same article according to the present invention so as to substantially enlarge the area of a grounding end of the self-complementary antenna to enable the self-complementary antenna to have the better radiation efficiency and the broader bandwidth such that the radio signal transmission effect of the electronic device is elevated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A grounded self-complementary antenna for elevating a radio signal transmission effect of an electronic device comprising:

a metal radiator used for responding to a plurality of electromagnetic waves in a wavelength range;

a metal complementary element being disposed adjacent to said metal radiator, and having an open zone being disposed at an inner portion thereof; and a metal grounding element disposed at said electronic device;

wherein said metal radiator has a specific shape and said open zone has a shape corresponding to said metal radiator to allow said metal radiator and said metal complementary element to form a self-complementary antenna; one end of said metal radiator, which is adjacent to said metal complementary element, has a feeding point for transmitting electromagnetic signals; said metal grounding element contacts and electrically connects with said metal complementary element for substantially enlarging an area of a grounding end of said self-complementary antenna; a first insulation material layer is disposed for said metal radiator being capable of not contacting with said metal grounding element; said metal complementary element and said metal grounding element contact with each other with a second insulation material layer being disposed for edges of said open zone being capable of not contacting with said metal grounding element.

2. The antenna according to claim 1, wherein said metal grounding element of is a metal housing, metal frame or electromagnetic wave interference prevention metal sheet provided at said electronic device.

3. The antenna according to claim 1, wherein said first insulation material layer and said second insulation material layer are integrally made as a single unit.

4. The antenna according to claim 3, wherein said first insulation material layer and said second insulation material layer are made in a form of a twin adhesive with two faces of said twin adhesive being respectively stuck onto said self-complementary antenna and said metal grounding element.

5. The antenna according to claim 1, wherein said metal complementary element and said metal grounding element are electrically connected to each other through a conducting pad.

6. The antenna according to claim 1, wherein said electronic device is a cellular phone, personal digital assistant with radio communication function, palm computer, notebook computer or desktop computer.

* * * * *

UNITED STATES PATENT AND TRADEMARK OFFICE

CERTIFICATE OF CORRECTION

PATENT NO. : 7,646,348 B2
APPLICATION NO. : 11/802096
DATED : January 12, 2010
INVENTOR(S) : Jiunn-Ming Huang et al.

It is certified that error appears in the above-identified patent and that said Letters Patent is hereby corrected as shown below:

Title Page, Item (73) should read

Name of Assignee: WISTRON NEWEB CORPORATION

Signed and Sealed this

Thirtieth Day of March, 2010

David J. Kappos

David J. Kappos
*Director of the United States Patent and Trademark Office*